US012349777B1

(12) United States Patent
Lee

(10) Patent No.: US 12,349,777 B1
(45) Date of Patent: Jul. 8, 2025

(54) COSMETIC PRODUCT AND METHOD OF ASSEMBLING A COSMETIC PRODUCT

(71) Applicant: ELC MANAGEMENT LLC, Melville, NY (US)

(72) Inventor: Wilson A. Lee, Hauppauge, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 18/666,140

(22) Filed: May 16, 2024

(51) Int. Cl.
*A45D 33/00* (2006.01)
*A45D 40/00* (2006.01)

(52) U.S. Cl.
CPC ..... *A45D 33/00* (2013.01); *A45D 40/00* (2013.01); *A45D 2040/0062* (2013.01)

(58) Field of Classification Search
CPC ..... A45D 33/00; A45D 40/00; A45D 33/003; A45D 2040/0062; A45D 40/205; A45D 40/02; A45D 40/04; A45D 40/06
USPC ..... 401/68, 75, 78, 88
See application file for complete search history.

(56) References Cited

U.S. PATENT DOCUMENTS 11,511,496 B2 11/2022 Gordon et al.
2003/0121235 A1* 7/2003 Maio ..... A45D 33/00 264/236
2024/0108118 A1 4/2024 Shannon et al.

* cited by examiner

*Primary Examiner* — David J Walczak
(74) *Attorney, Agent, or Firm* — MARSHALL, GERSTEIN & BORUN LLP

(57) ABSTRACT

A cosmetic product includes a cup and a cosmetic substance. The cup has a sidewall and a floor member defining a cup cavity The floor member includes a first elongated ridge extending across the floor member and protruding from an inner surface of the floor member into the cup cavity and a second elongated ridge extending across the floor member, protruding from the inner surface of the floor member into the cup cavity, and intersecting the first elongated protrusion. At least a portion of the cosmetic substance is disposed within the cup cavity. A pressure sensitive adhesive is located between and contacts the cup, between the first elongated ridge and the second elongated ridge, and the cosmetic substance.

20 Claims, 15 Drawing Sheets

COSMETIC PRODUCT AND METHOD OF ASSEMBLING A COSMETIC PRODUCT

FIELD OF THE DISCLOSURE

The present disclosure generally relates to cosmetic, hair care, body care, and/or skincare products and, more particularly, to systems and methods for retaining cosmetic substances in the cosmetic products.

BACKGROUND

Cosmetic, hair care, body care, and/or skincare products may have various cosmetic substances provided in a number of different containers, and may be applied using a number of varying approaches. As an example, a lipstick or lip balm substance may be in the form of an elongated tube, cylinder, square, rectangular, and/or diamond prism, among other shapes that is disposed in a protective container. Such containers may allow the lipstick or lip balm substance to selectively advance to an extended position relative to the container to be applied by the user. The lipstick or lip balm substance may be a generally solid, yet relatively soft, molded composition that may be inserted into a cavity of a retaining cup of the container. In the event the container and/or cup is inadvertently dropped or otherwise jostled, the lipstick or lip balm substance may become damaged, broken, or otherwise detached from the retaining cup. In some examples, the retaining cup (or other features of the container) may include discrete retention members in the form of hooks, nodules, or similar components that may be urged into the cosmetic substance in an attempt to prevent or otherwise limit movement of the lipstick or lip balm substance relative to the cup and the container during these inadvertent drops or bumps. However, these features may create localized stress points that may ultimately deform or otherwise damage the cosmetic substance.

Accordingly, there is a need for improved cosmetic products having improved retention of the cosmetic substance.

SUMMARY

Examples within the scope of the present disclosure are directed to cosmetic products and methods of assembling cosmetic products.

In one example cosmetic product, the cosmetic product may include a cup for retaining a cosmetic substance. The cup has a sidewall and a floor member defining a cup cavity. The floor member includes a first elongated ridge extending across the floor member and protruding from an inner surface of the floor member into the cup cavity and a second elongated ridge extending across the floor member, protruding from the inner surface of the floor member into the cup cavity, and intersecting the first elongated ridge. At least a portion of a cosmetic substance is disposed within the cup cavity. A pressure sensitive adhesive is located between and contacts the floor member of the cup, between the first elongated ridge and the second elongated ridge, and the cosmetic substance to retain the cosmetic substance in the cup.

In some examples, the pressure sensitive adhesive is a hot melt adhesive.

In some examples, the pressure sensitive adhesive is silicone based.

In some examples, the cosmetic product comprises an inner body and the cup is configured to be at least partially disposed within the inner body.

In some examples, the cup comprises a cup retention member extending from an outer surface of the sidewall and the cup retention member is configured to engage a notch formed in the inner body.

In some examples, the cup retention member is configured to apply an urging force towards the cup cavity with the cup inserted into the inner body.

In some examples, the floor member comprises an aperture formed through the floor member, at least a portion of the aperture being positioned between the first elongated ridge and the second elongated ridge.

In one example cosmetic product, the cosmetic product may include a cup for retaining a cosmetic substance. The cup has a sidewall and a floor member defining a cup cavity. The floor member includes a first elongated groove extending across the floor member and protruding into an inner surface of the floor member and a second elongated groove extending across the floor member, protruding into the inner surface of the floor member, and intersecting the first elongated groove. At least a portion of a cosmetic substance is disposed within the cup cavity. A pressure sensitive adhesive is located at least partially within the first elongated groove and the second elongated groove and contacts the first elongated groove and the second elongated groove of the floor member of the cup and the cosmetic substance.

In some examples, the pressure sensitive adhesive is a hot melt adhesive.

In some examples, the pressure sensitive adhesive is silicone based.

In some examples, the cosmetic product comprises an inner body and the cup is configured to be at least partially disposed within the inner body.

In some examples, the cup comprises a cup retention member extending from an outer surface of the sidewall and the cup retention member is configured to engage a notch formed in the inner body.

In some examples, the cup retention member is configured to apply an urging force towards the cup cavity with the cup inserted into the inner body.

In some examples, the floor member comprises an aperture formed through the floor member. At least a portion of the aperture is positioned between the first elongated groove and the second elongated groove.

In one example method of assembling a cosmetic product, a metal pan is formed and defines a pan cavity; a pressure sensitive adhesive is inserted into the pan cavity; a granular cosmetic substance is inserted into the pan cavity; and the granular cosmetic substance is compacted in the metal pan such that the pressure sensitive adhesive is located between and contacts at least a portion of the metal pan and at least a portion of the compacted granular cosmetic substance.

In some examples, the metal pan is secured in an external housing.

In some examples, inserting the pressure sensitive adhesive into the pan cavity comprises positioning the pressure sensitive adhesive on an inner surface of a floor member of the metal pan such that the pressure sensitive adhesive is located between and contacts the inner surface of the floor member of the metal pan and a bottom surface of the compacted granular cosmetic substance.

In some examples, inserting the pressure sensitive adhesive into the pan cavity comprising positioning the pressure sensitive adhesive on an inner surface of a sidewall of the metal pan such that the pressure sensitive adhesive is located between and contacts the inner surface of the sidewall of the metal pan and a side surface of the compacted granular cosmetic substance.

In some examples, the pressure sensitive adhesive forms an annular ring.

In some examples, the pressure sensitive adhesive is silicone based.

BRIEF DESCRIPTION OF THE DRAWINGS

The above needs are at least partially met through provision of one, more than one, or any combination of the cosmetic products and methods of assembling cosmetic products described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, cosmetic products and methods of assembling cosmetic products are provided that adequately retain a cosmetic substance (e.g., lipsticks, lip balms, deodorants/antiperspirants, pressed powders, etc.) during use as well as in the event of inadvertent drops and/or bumps. The approaches described herein provide retention of the cosmetic substance while still providing a degree of removability and reworkability, which can reduce the number of reworks and rejects for a cosmetic product. These approaches can be used to contain and retain a multitude of cosmetic substances having varying degrees of material softness.

Figure 1:
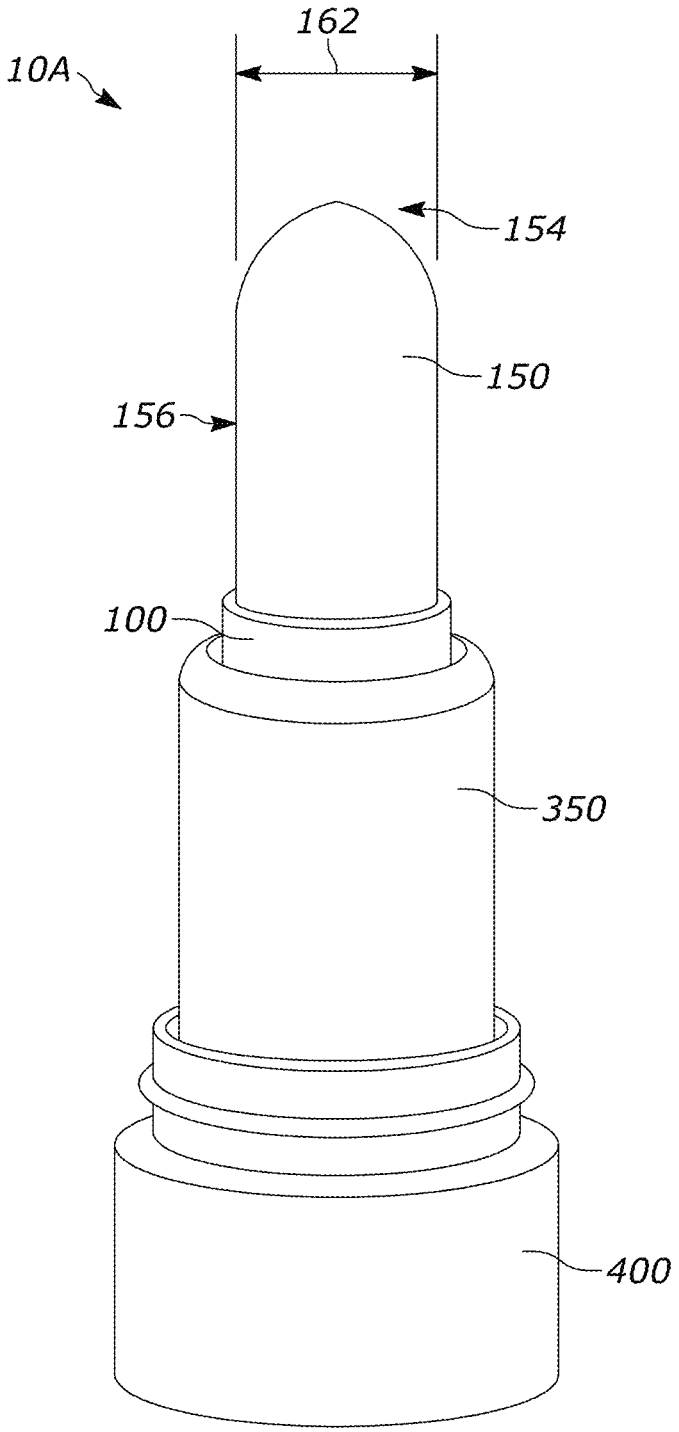
FIG. 1 illustrates a front elevation view of a first example cosmetic product in accordance with various examples.
Figure 2:
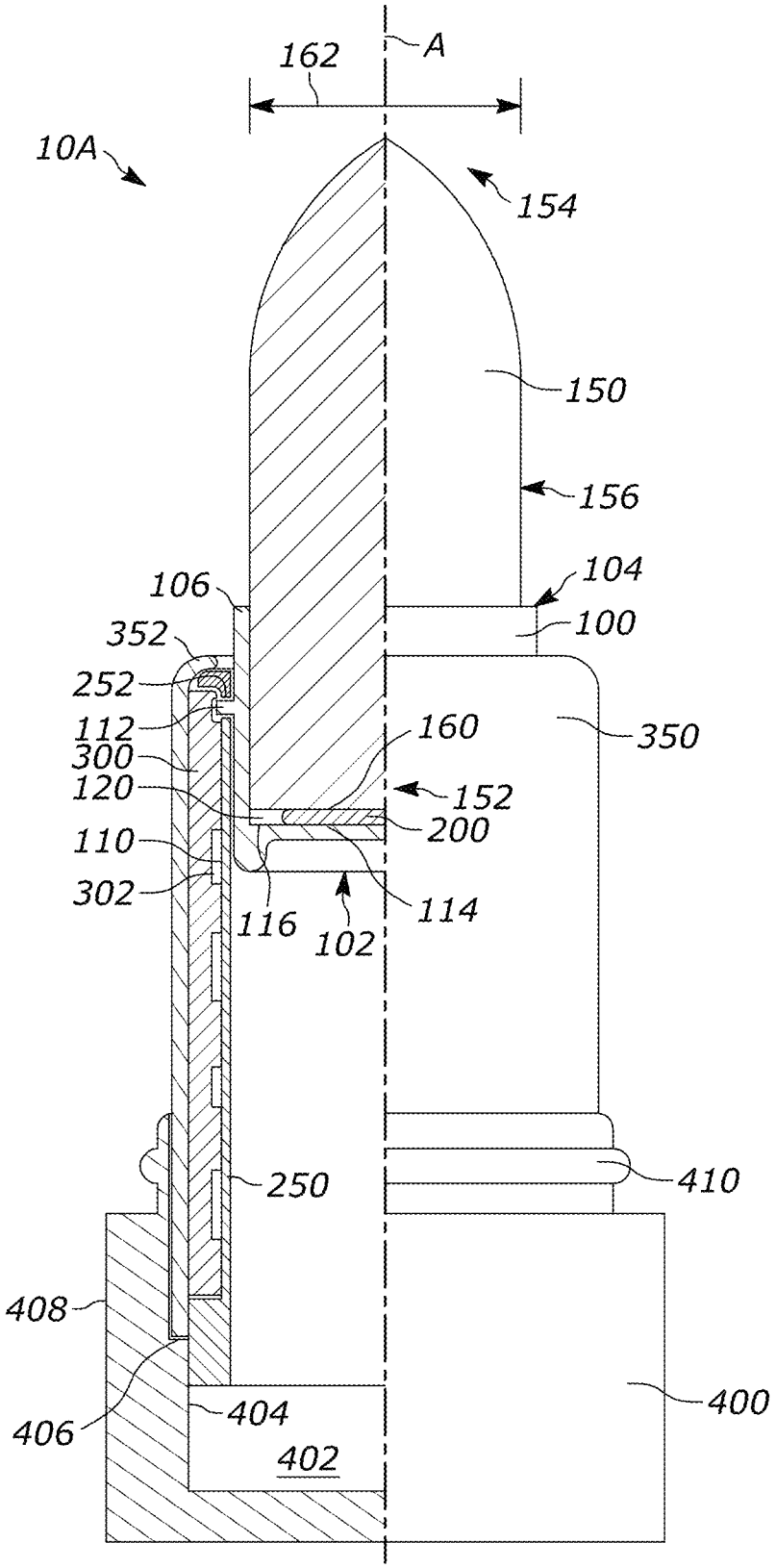
FIG. 2 illustrates a partial cross-sectional front view of the cosmetic product of FIG. 1 having a first example cosmetic substance retention mechanism.

Referring to FIGS. 1 and 2, a first example cosmetic product 10A is illustrated that contains a cosmetic substance 150. Cosmetic product 10A generally includes a base 400, a track 300, an inner body 250, a shell 350, and a cup 100 that retains cosmetic substance 150. In the illustrated examples, cosmetic substance 150 is in the form of a lipstick or lip balm product, but could be any type of cosmetic, hair care, body care, and/or skincare product that may be applied to a user. Other examples are possible. In some of these examples, cosmetic substance 150 may include strong or otherwise aggressive chemicals and/or ingredients such as, for example, volatiles. In the example shown, cosmetic substance 150 includes a first end 152, a second end 154, and an elongated body 156 extending between first end 152 and second end 154 along a longitudinal axis ("A"). Cosmetic substance 150 defines an outer cross-sectional dimension 162. In the example shown, cosmetic substance 150 is generally cylindrical and outer cross-sectional dimension 162 is in the form of an outer diameter or circumference. However, other examples are possible.

Base 400 is configured to at least partially retain various components of cosmetic product 10 in a base cavity 402. Base cavity 402 defines a ledge 406 formed on an inner surface 404 of base 400, and can also include a securement mechanism 410 formed on an outer surface 408 of base 400. Securement mechanism 410 may be used to engage a portion of a cap (not illustrated) to conceal cosmetic substance 150 for storage purposes. Any number of suitable securement mechanisms 410 may be used such as, for example, a snap-fit coupling, a friction-fit coupling, a threaded connection, and the like. Other examples are possible.

Track 300 is at least partially disposed within base cavity 402 and defines a channel 302. Inner body 250 is at least partially disposed within base cavity 402 and includes a notch 252. Shell 350 is also at least partially disposed within base cavity 402 and is provided to prevent a user from observing inner body 250 and track 300. Shell 350 includes a lip 352 that engages a portion of inner body 250 to restrict movement of inner body 250 in a direction along longitudinal axis A. It is to be appreciated that any of base 400, track 300, inner body 250, and/or shell 350 may include any number of additional features and/or components to assist in use of cosmetic product 10A, but for the sake of brevity, such features and/or components will not be discussed in substantial detail herein.

Cup 100 includes a sidewall 106 and a floor member 114 that together define a cup cavity 120 and at least a portion of cosmetic substance 150 is disposed within cup cavity 120. In the example shown, sidewall 106 is generally cylindrical and extends from a first end 102 of cup 100 to a second end 104 of cup 100. Cup 100 may be formed from any number of desired materials and can include a cup retention member 112 that extends from an outer surface 110 of sidewall 106 and is configured to engage notch 252 formed in inner body 250.

Cup 100 is configured to be at least partially disposed within inner body 250. Upon coupling cup 100 with inner body 250, cup retention member 112 is positioned within notch 252 of inner body 250 to prevent or otherwise limit relative movement between inner body 250 and cup 100. In some implementations, inserting cup 100 into inner body 250 may cause cup retention member 112 to apply an inwardly directed urging or compressive force towards cup cavity 120.

To assist in retaining cosmetic substance 150 in cup cavity 120 of cup 100, a pressure sensitive adhesive 200 (e.g., Dow Corning® HM-1422) is located between and contacts cup 100 and cosmetic substance 150. In the example shown, pressure sensitive adhesive 200 is located between and contacts an inner surface 116 of floor member 114 of cup 100 and a bottom surface 160 of cosmetic substance 150. In the example shown, a single segment of pressure sensitive adhesive 200 is located between floor member 114 and cosmetic substance 150. However, any number, shape, size, and/or thickness of segments of pressure sensitive adhesive 200 may be used.

Pressure sensitive adhesive 200 can be a hot melt adhesive and/or can be silicone based, which can adhere to silicone and other low energy surfaces, and is typically partially cross-lined of resin and polymer. Both low and high viscosity pressure sensitive materials can be used. Pressure sensitive adhesive 200 can have a contact angle from 100 degrees to 120 degrees with a viscosity between 4000 centipoise (cP) and 8000 cP at temperatures ranging from 110° C. to 130° C. In some implementations, such as use with cosmetic substances having a lower contact angle (e.g., between 48 degrees and 69 degrees), a lower viscosity pressure sensitive adhesive is preferred, which yields better adhesive performance. Conversely, when used with cosmetic substances having a higher contact angle (e.g., greater than 70 degrees), a higher viscosity pressure sensitive adhesive would be preferred.

In some implementations, pressure sensitive adhesive 200 can remain tacky through its lifetime, can adhere to surfaces with slight pressure and release from the surfaces with negligible transfer of the pressure sensitive adhesive to the surface, can maintain adhesion through a wide temperature range, and can be solvent free. Pressure sensitive adhesive preferably holds tight when experiencing shock or fast movement, but, if pulled slowly, can be removed. Between 0.15 grams and 0.30 grams of pressure sensitive adhesive 200 can be used in cosmetic product 10A to create an adhesion force between 950 gf and 1,100 gf.

Figure 3A:
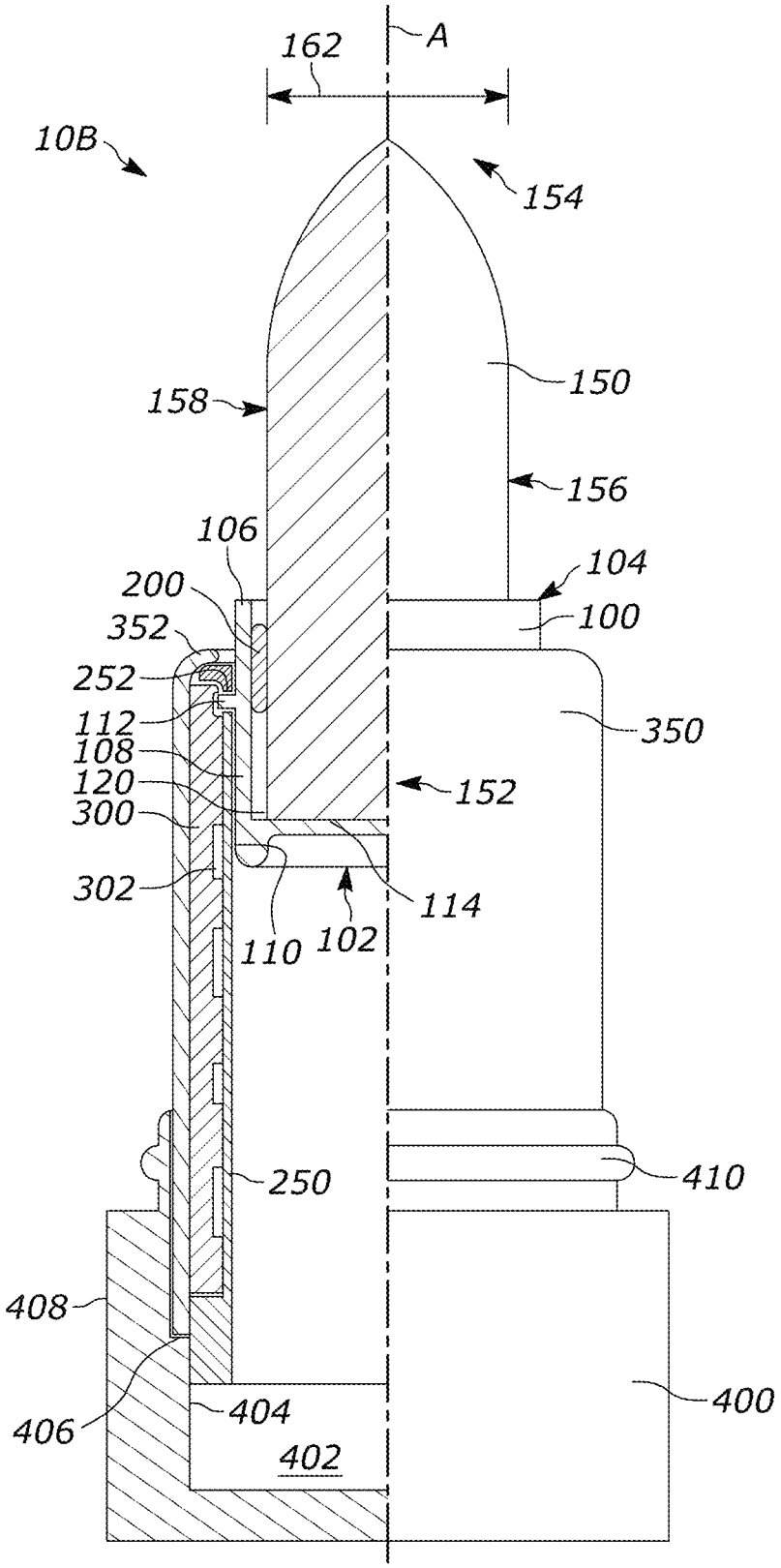
FIG. 3A illustrates a partial cross-sectional front view of the cosmetic product of FIG. 1 having a second example cosmetic substance retention mechanism.
Figure 3B:
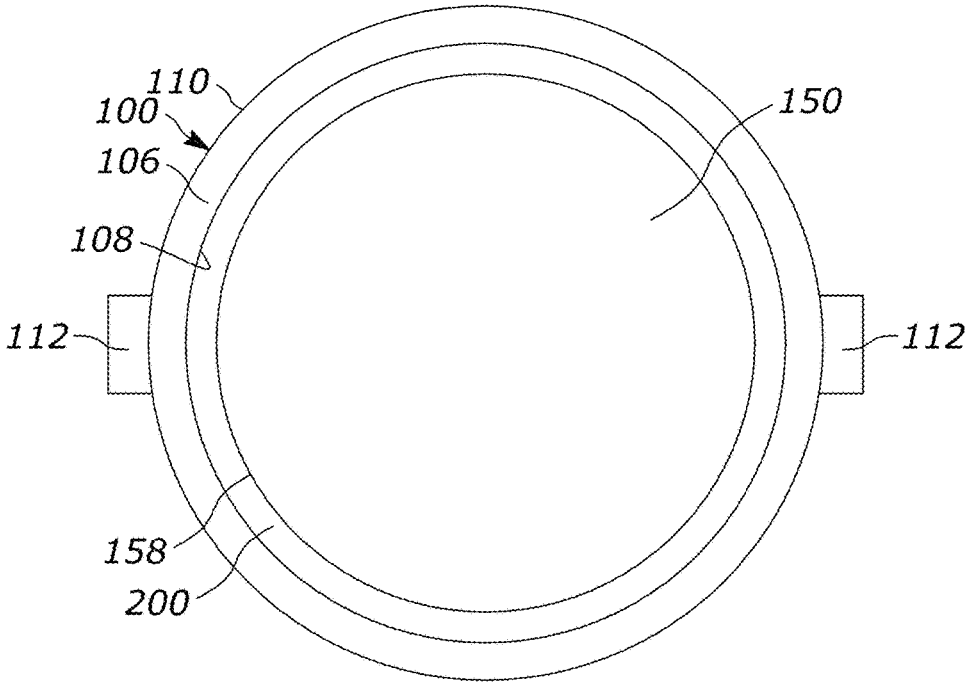
FIG. 3B illustrates a top view of a cup and cosmetic substance of the cosmetic product of FIG. 3A having a first example pressure sensitive adhesive configuration.
Figure 3C:
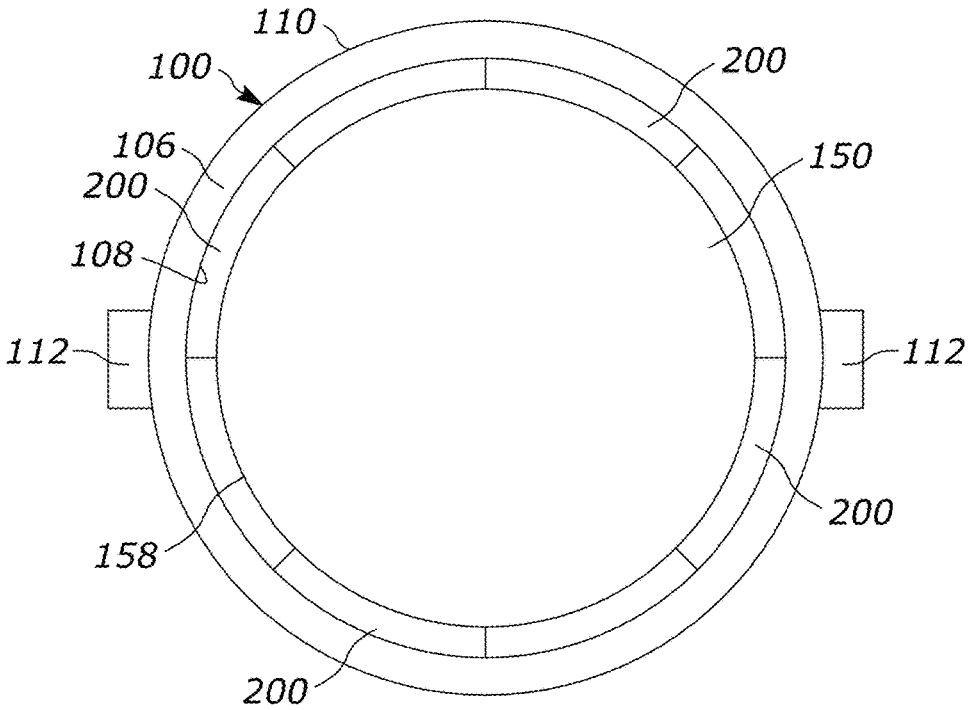
FIG. 3C illustrates a top view of a cup and cosmetic substance of the cosmetic product of FIG. 3A having a second example pressure sensitive adhesive configuration.

Referring to FIGS. 3A-C, a second example cosmetic product 10B is illustrated. Cosmetic product 10B is substantially the same as cosmetic product 10A, except that pressure sensitive adhesive 200 is located between and contacts an inner surface 108 of sidewall 106 of cup 100 and a side surface 158 of cosmetic substance 150. In the example shown in FIGS. 3A-B, pressure sensitive adhesive 200 forms a continuous annular ring around the circumference of inner surface 108 of sidewall 106 of cup 100. Alternatively, as shown in FIG. 3C, rather than a continuous annular ring, pressure sensitive adhesive 200 can have multiple spaced apart sections at different locations along inner surface 108 of sidewall 106. Other configurations for pressure sensitive adhesive 200 are also possible, such as a single non-annular section, multiple annular rings, etc.

Figure 4:
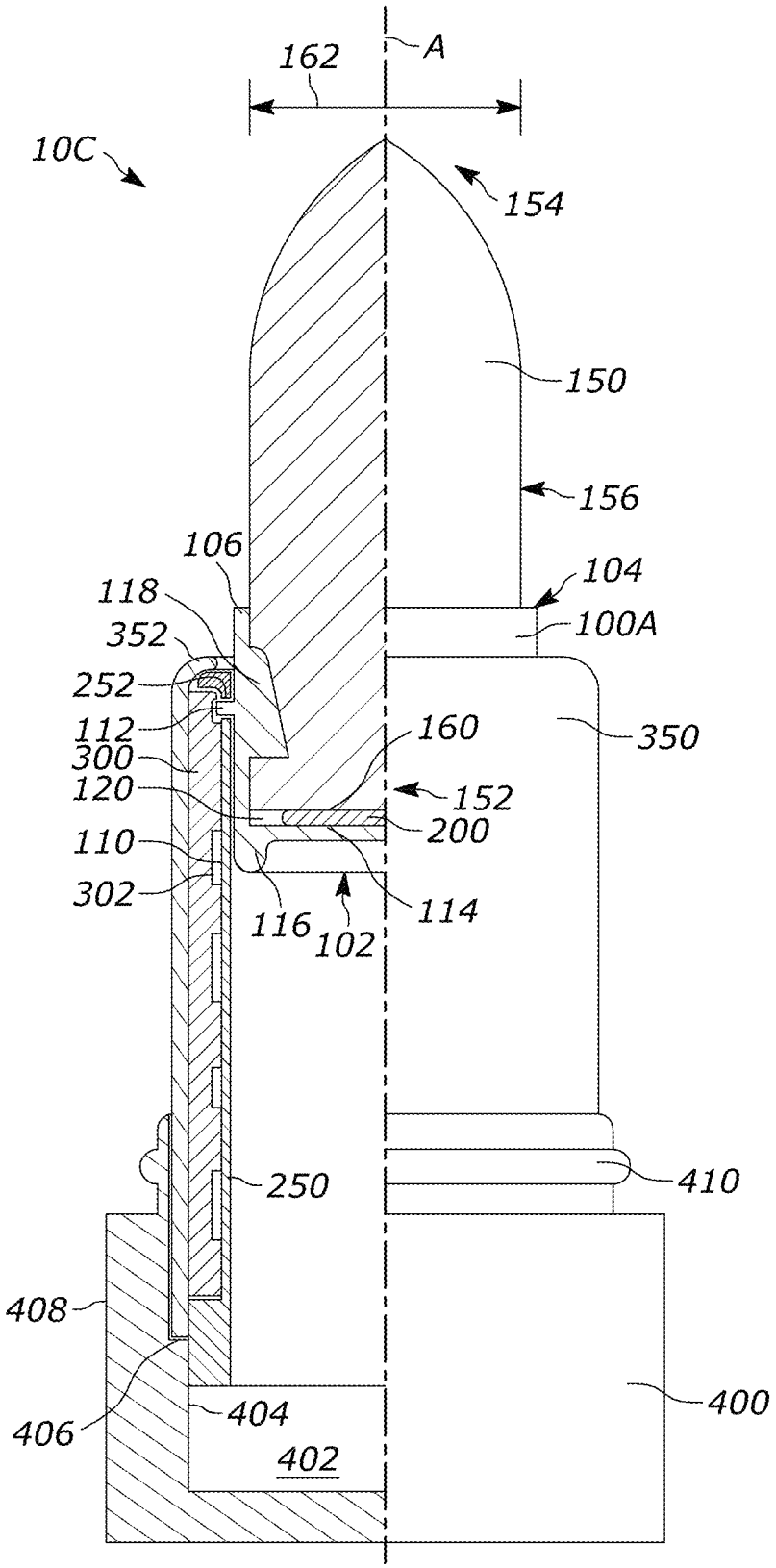
FIG. 4 illustrates a partial cross-sectional front view of the cosmetic product of FIG. 1 having a third example cosmetic substance retention mechanism.

Referring to FIG. 4, a third example cosmetic product 10C is illustrated. Cosmetic product 10C is substantially the same as cosmetic product 10A, except that cup 100A includes at least one longitudinally extending rib 118 that extends from an inner surface 108 of sidewall 106 and radially into cup cavity 120. While ribs 118 are illustrated as extending generally longitudinally (i.e., generally parallel to longitudinal axis A), in some implementations, ribs 118 may be arranged in a non-longitudinal direction or a helical arrangement. Other arrangements are also possible.

Figure 5A:
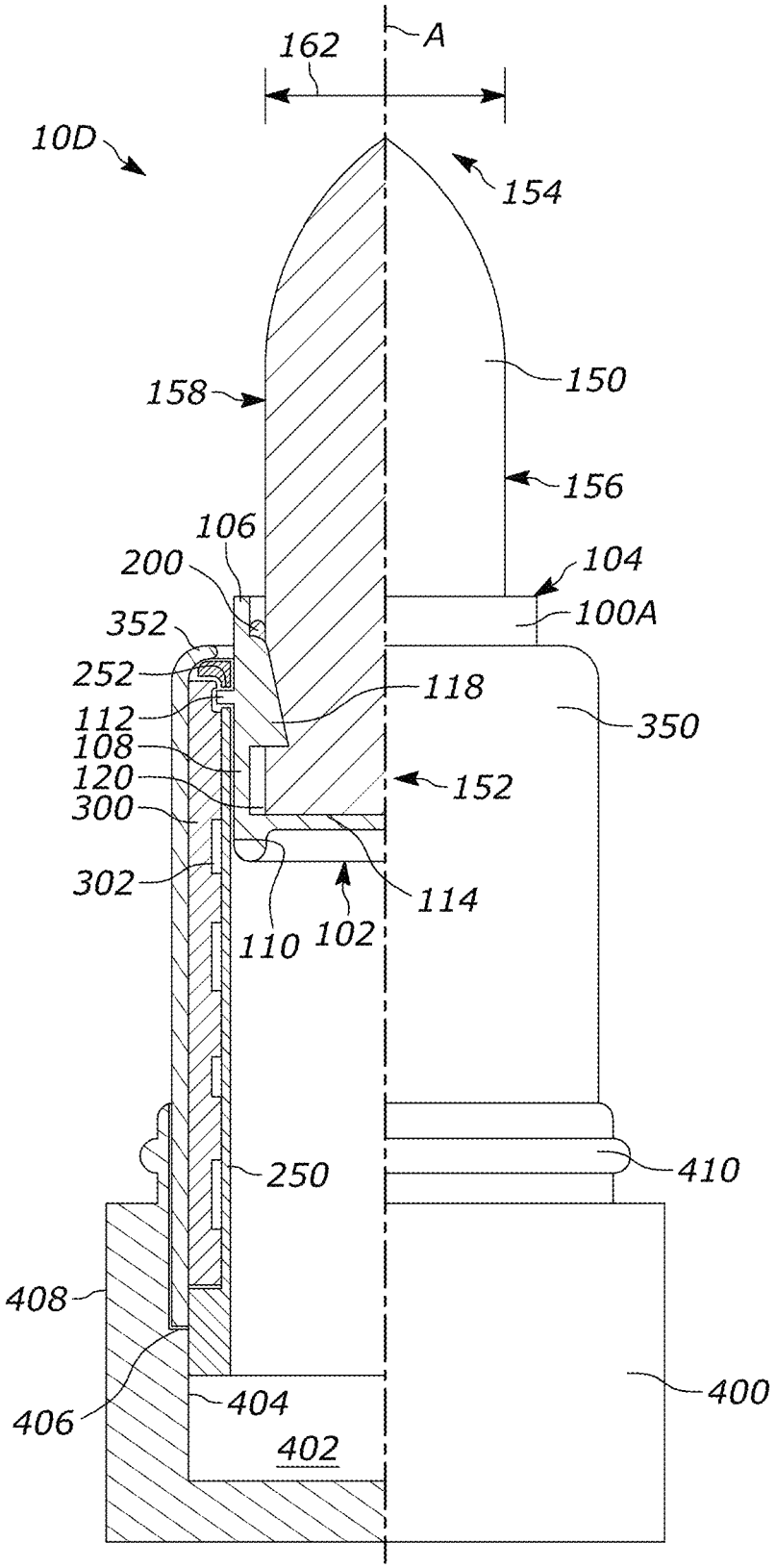
FIG. 5A illustrates a partial cross-sectional front view of the cosmetic product of FIG. 1 having a fourth example cosmetic substance retention mechanism.
Figure 5B:
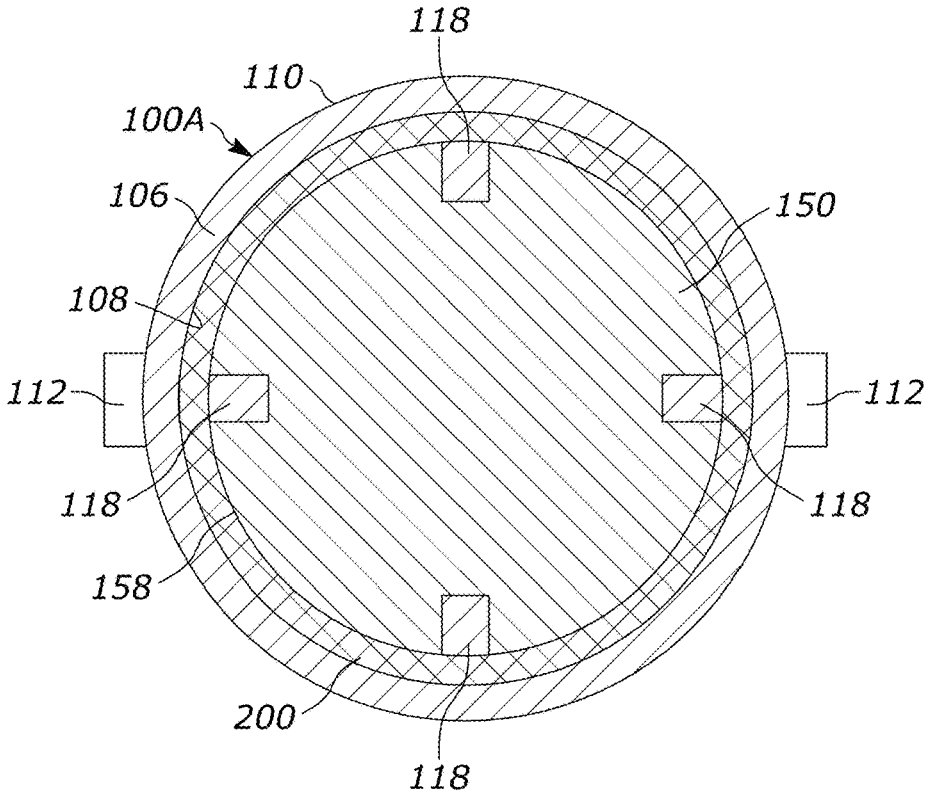
FIG. 5B illustrates a top cross-sectional view of a cup and cosmetic substance of the cosmetic product of FIG. 5A having a third example pressure sensitive adhesive configuration.
Figure 5C:
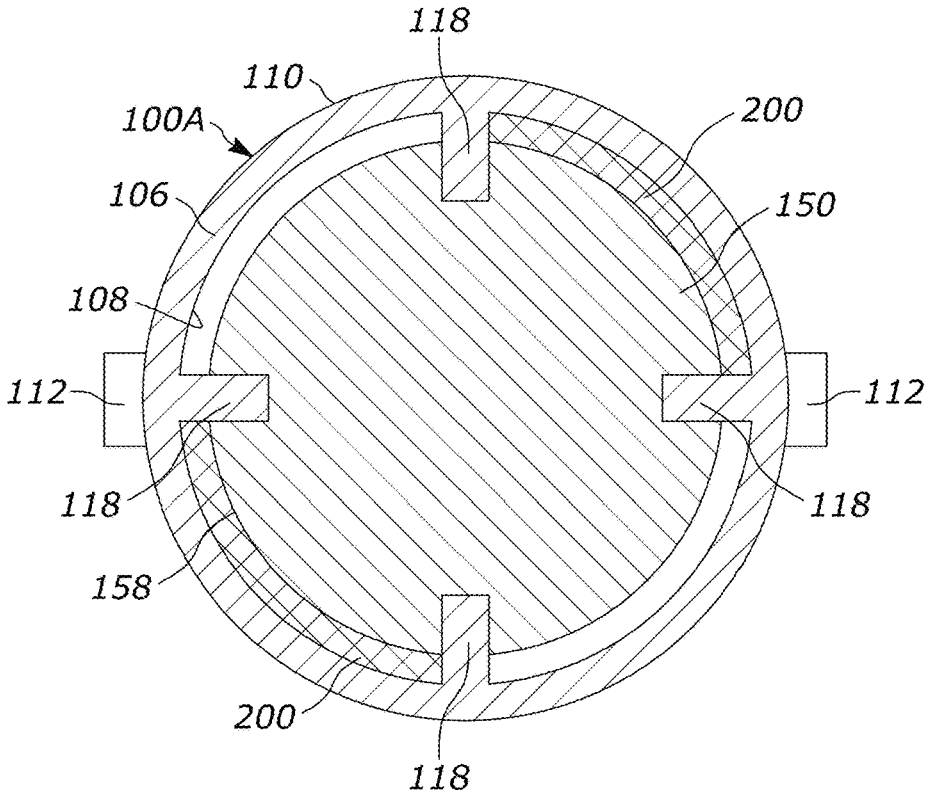
FIG. 5C illustrates a top cross-sectional view of a cup and cosmetic substance of the cosmetic product of FIG. 5A having a fourth example pressure sensitive adhesive configuration.

Referring to FIGS. 5A-C, a fourth example cosmetic product 10D is illustrated. Cosmetic product 10D is substantially the same as cosmetic product 10B, except that cup 100A includes at least one longitudinally extending rib 118 that extends from an inner surface 108 of sidewall 106 and radially into cup cavity 120. While ribs 118 are illustrated as extending generally longitudinally (i.e., generally parallel to longitudinal axis A), in some implementations, ribs 118 may be arranged in a non-longitudinal direction or a helical arrangement. Other arrangements are also possible. In the example shown in FIGS. 5A-B, pressure sensitive adhesive 200 forms a continuous annular ring around the circumference of inner surface 108 of sidewall 106 of cup 100A and is located above or below ribs 118. Alternatively, as shown in FIG. 5C, rather than a continuous annular ring, pressure sensitive adhesive 200 can have multiple sections located between ribs 118. As shown, pressure sensitive adhesive 200 has two sections, each between a respective pair of ribs 118. However, there could be as many section of pressure sensitive adhesive 200 as desired between as many pairs of ribs 118 as desired. Other configurations for pressure sensitive adhesive 200 are also possible, such as a single non-annular section, multiple annular rings, multiple sections spaced longitudinally, etc.

Figure 6A:
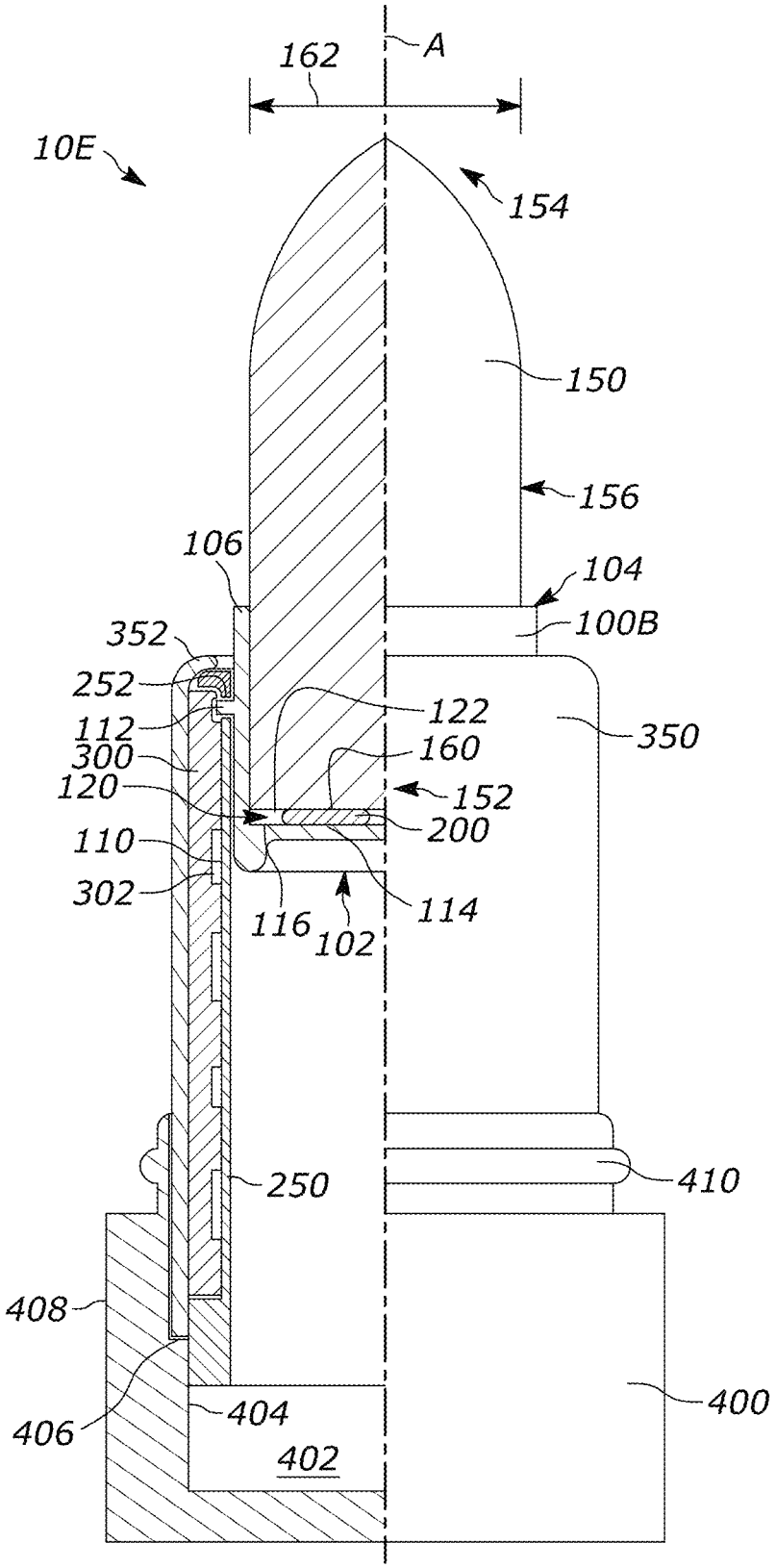
FIG. 6A illustrates a partial cross-sectional front view of the cosmetic product of FIG. 1 having a fourth example cosmetic substance retention mechanism.
Figure 6B:
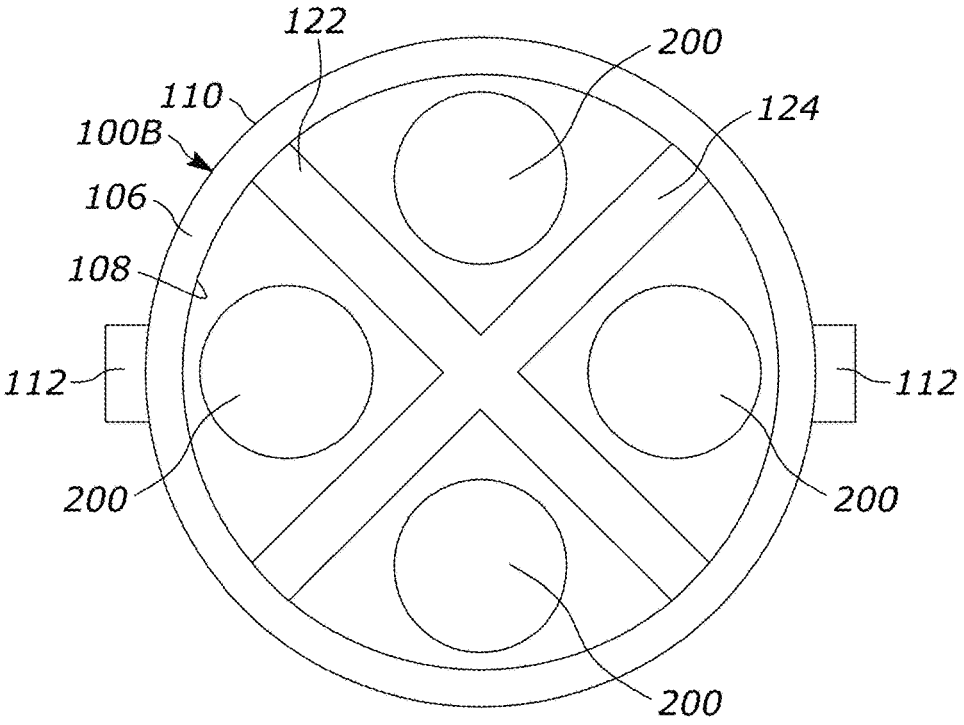
FIG. 6B illustrates a top view of the cup and pressure sensitive adhesive of the cosmetic product of FIG. 6A having a fifth example pressure sensitive adhesive configuration.
Figure 6C:
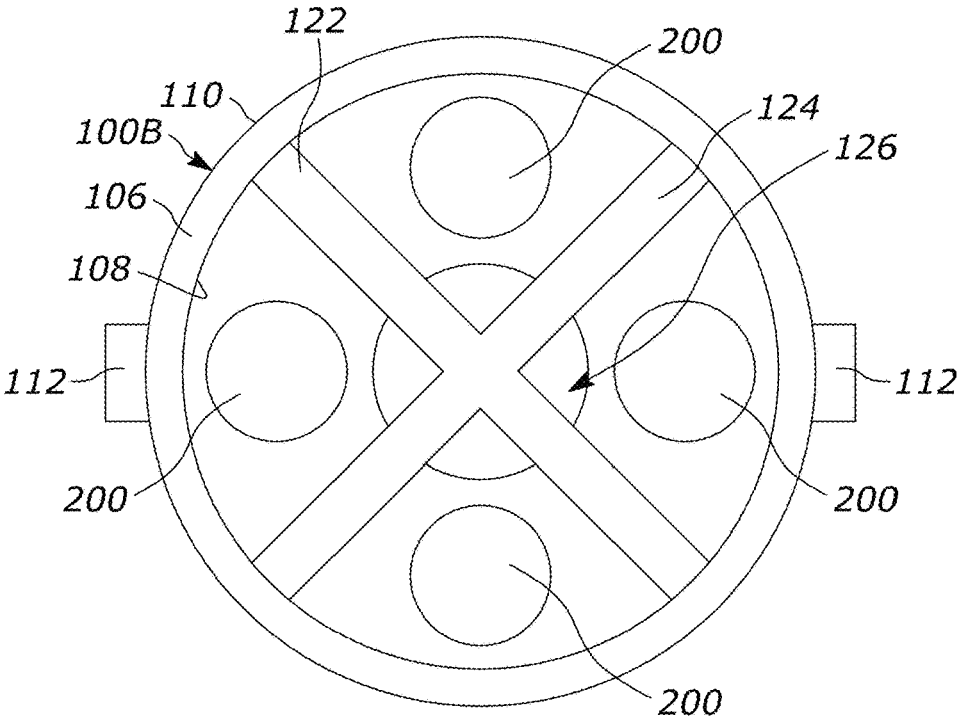
FIG. 6C illustrates a top view of the cup and pressure sensitive adhesive of the cosmetic product of FIG. 6A having a sixth example pressure sensitive adhesive configuration.

Referring to FIGS. 6A-C, a fifth example cosmetic product 10E is illustrated. Cosmetic product 10E is substantially the same as cosmetic product 10A, except that cup 100B includes a first elongated ridge 122 and a second elongated ridge 124, intersecting first elongated ridge 122. First elongated ridge 122 and second elongated ridge 124 each extend across floor member 114 and protrude from inner surface 116 of floor member 114 into cup cavity 120. While first elongated ridge 122 and second elongated ridge 124 are illustrated as extending perpendicular to each other and extending between opposite sides of sidewall 106, in some implementations, first elongated ridge 122 and second elongated ridge 124 could extend in other angular orientations to each other and could be spaced apart from sidewall 106. In addition, there could be additional elongated ridges that extend at other angles to first elongated ridge 122 and second elongated ridge 124. Other arrangements are also possible.

Pressure sensitive adhesive 200 is located between and contacts cup 100C and cosmetic substance 150 and is located between first elongated ridge 122 and second elongated ridge 124. In the example shown, pressure sensitive adhesive 200 is applied in each of the areas of inner surface 116 of floor member 114 formed between first elongated ridge 122 and second elongated ridge 124. However, pressure sensitive adhesive 200 can be applied to any number of areas (e.g., one, two, etc.) formed between the elongated ridges in any shape, size, and/or thickness.

Alternatively, as shown in FIG. 6C, floor member 114 can also have an aperture 126 formed therethrough to allow the passage of air out of cup cavity 120 as cosmetic substance 150 is inserted. At least a portion of aperture 126 is positioned between first elongated ridge 122 and second elongated ridge 124. As illustrated in FIG. 6C, aperture 126 can be a single aperture that is formed through floor member 114, extends underneath first elongated ridge 122 and second elongated ridge 124, and extends into each of the areas formed between first elongated ridge 122 and second elongated ridge 124. In other implementations, there could be multiple apertures, each extending through floor member 114 and each being located in a separate area formed between first elongated ridge 122 and second elongated ridge 124. In addition, the aperture(s) could be located in any number of areas formed between first elongated ridge 122 and second elongated ridge 124. Other arrangements are also possible.

Figure 7:
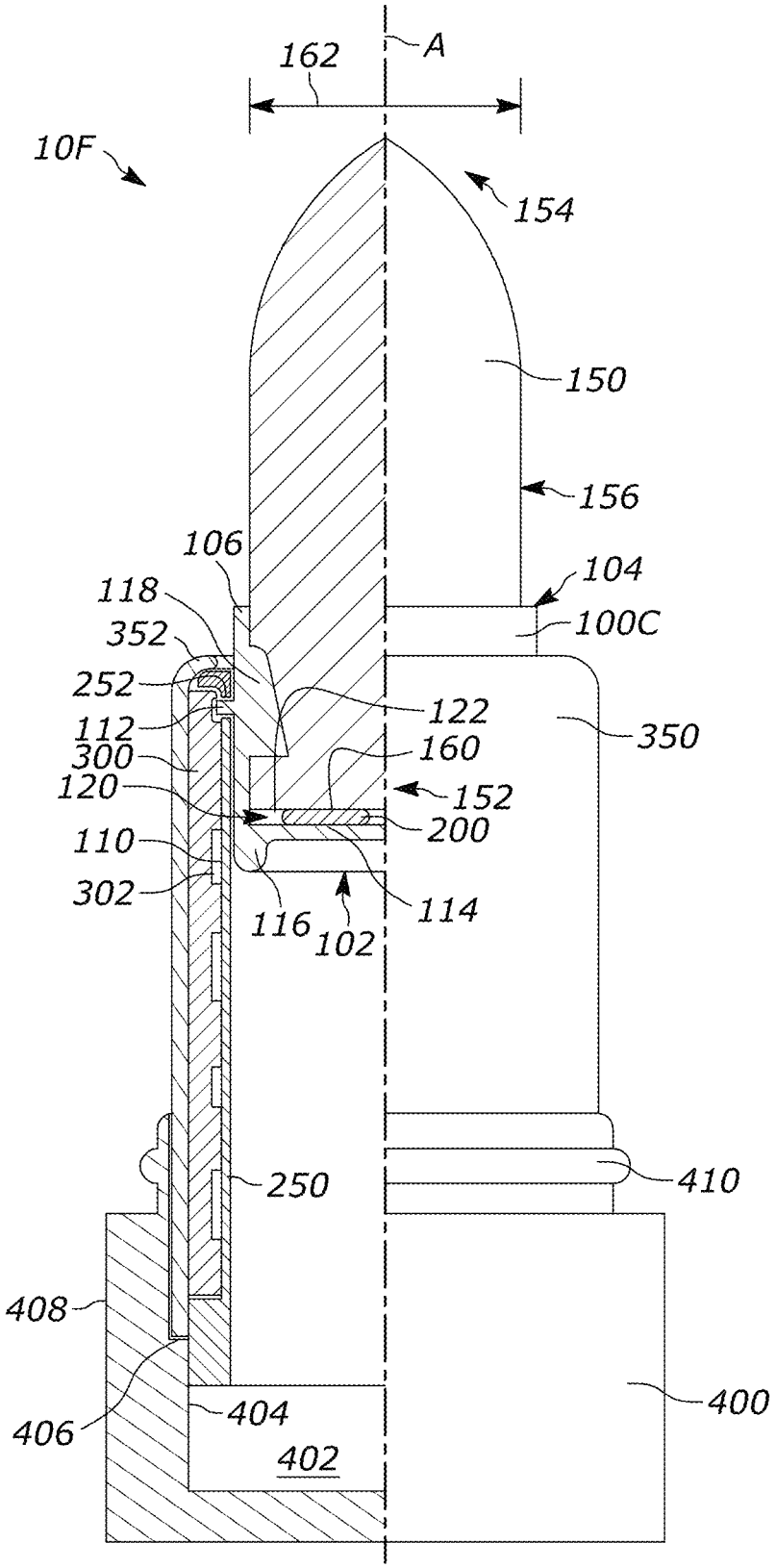
FIG. 7 illustrates a partial cross-sectional front view of the cosmetic product of FIG. 1 having a fifth example cosmetic substance retention mechanism.

Referring to FIG. 7, a sixth example cosmetic product 10F is illustrated. Cosmetic product 10F is substantially the same as cosmetic product 10E, except that cup 100C includes at least one longitudinally extending rib 118 that extends from an inner surface 108 of sidewall 106 and radially into cup cavity 120. While ribs 118 are illustrated as extending generally longitudinally (i.e., generally parallel to longitudinal axis A), in some implementations, ribs 118 may be arranged in a non-longitudinal direction or a helical arrangement. Other arrangements are also possible.

Figure 8A:
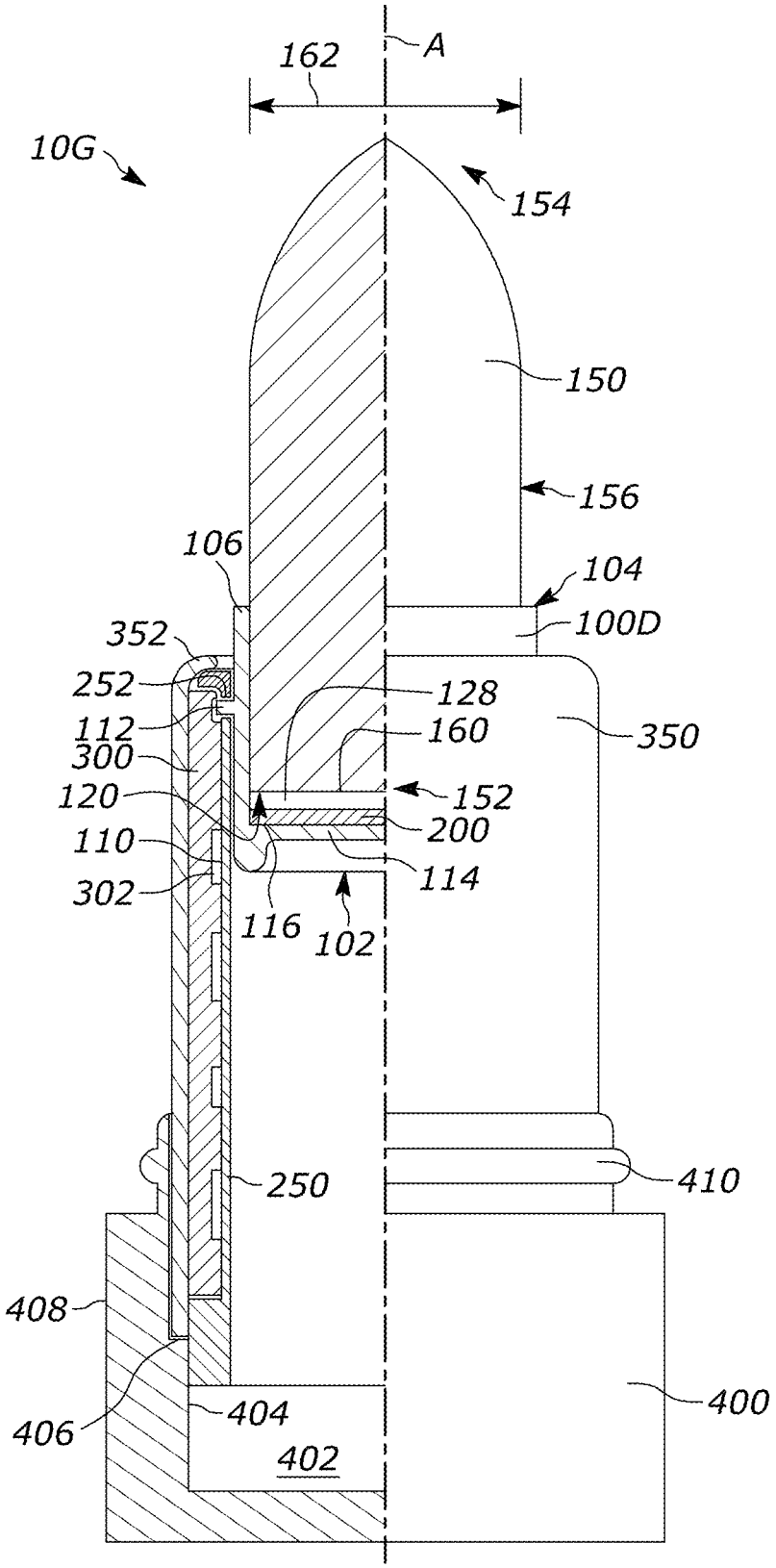
FIG. 8A illustrates a partial cross-sectional front view of the cosmetic product of FIG. 1 having a sixth example cosmetic substance retention mechanism.
Figure 8B:
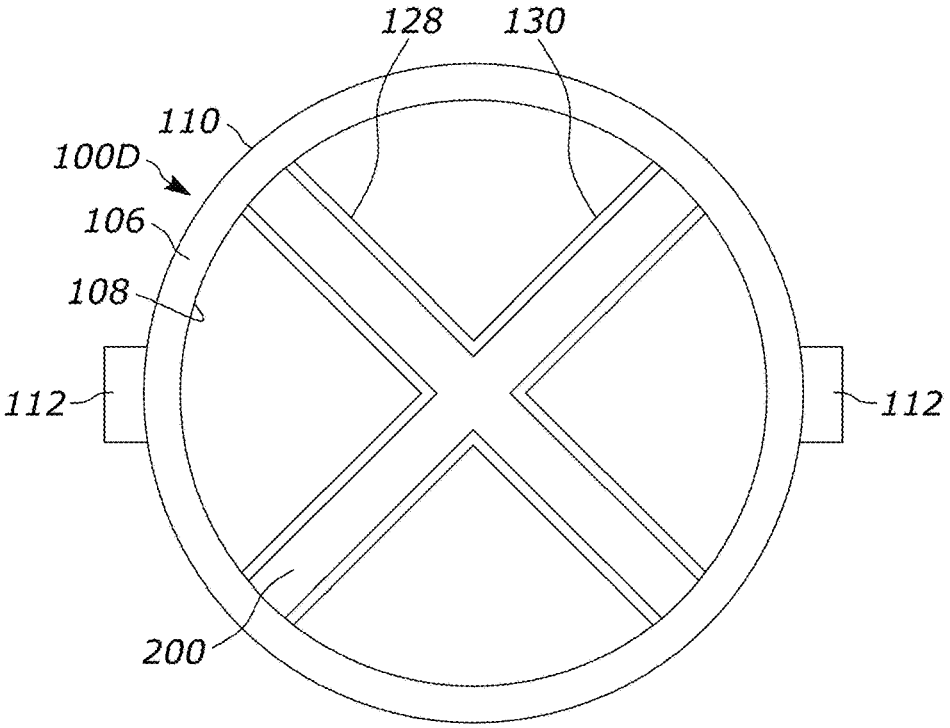
FIG. 8B illustrates a top view of the cup and pressure sensitive adhesive of the cosmetic product of FIG. 8A having a seventh example pressure sensitive adhesive configuration.
Figure 8C:
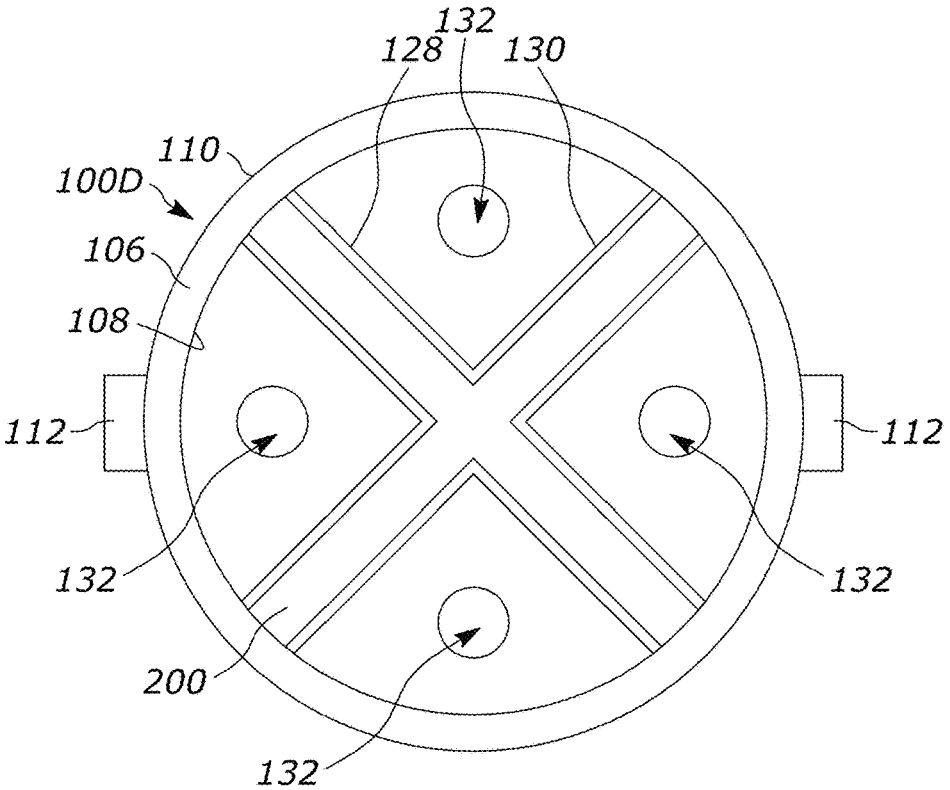
FIG. 8C illustrates a top view of the cup and pressure sensitive adhesive of the cosmetic product of FIG. 8A having an eighth example pressure sensitive adhesive configuration.

Referring to FIGS. 8A-C, a seventh example cosmetic product 10G is illustrated. Cosmetic product 10G is substantially the same as cosmetic product 10A, except that cup 100D includes a first elongated groove 128 and a second elongated groove 130, intersecting first elongated groove 128. First elongated groove 128 and second elongated groove 130 each extend across floor member 114 and protrude into inner surface 116 of floor member 114. While first elongated groove 128 and second elongated groove 130 are illustrated as extending perpendicular to each other and extending between opposite sides of sidewall 106, in some implementations, first elongated groove 128 and second elongated groove 130 could extend in other angular orientations to each other and could be spaced apart from sidewall 106. In addition, there could be additional elongated grooves that extend at other angles to first elongated groove 128 and second elongated groove 130. Other arrangements are also possible.

Pressure sensitive adhesive 200 is located at least partially within first elongated groove 128 and second elongated groove 130 and contacts first elongated groove 128 and second elongated groove 130 and cosmetic substance 150. In the example shown, pressure sensitive adhesive 200 is applied in both first elongated groove 128 and second elongated groove 130. However, pressure sensitive adhesive 200 can be applied in one groove or both grooves in any shape, size, and/or thickness.

Alternatively, as shown in FIG. 8C, floor member 114 can also have an aperture 132 formed therethrough to allow the passage of air out of cup cavity 120 as cosmetic substance 150 is inserted. At least a portion of aperture 132 is positioned between first elongated groove 128 and second elongated groove 130. As illustrated in FIG. 8C, a single aperture 132 is formed through floor member 114 into an area formed between first elongated groove 128 and second elongated groove 130. In other implementations, there could be multiple apertures, each extending through floor member 114 and each being located in a separate area formed between first elongated groove 128 and second elongated groove 130. In addition, the aperture(s) could be located in any number of areas formed between first elongated groove 128 and second elongated groove 130. Other arrangements are also possible.

Figure 9:
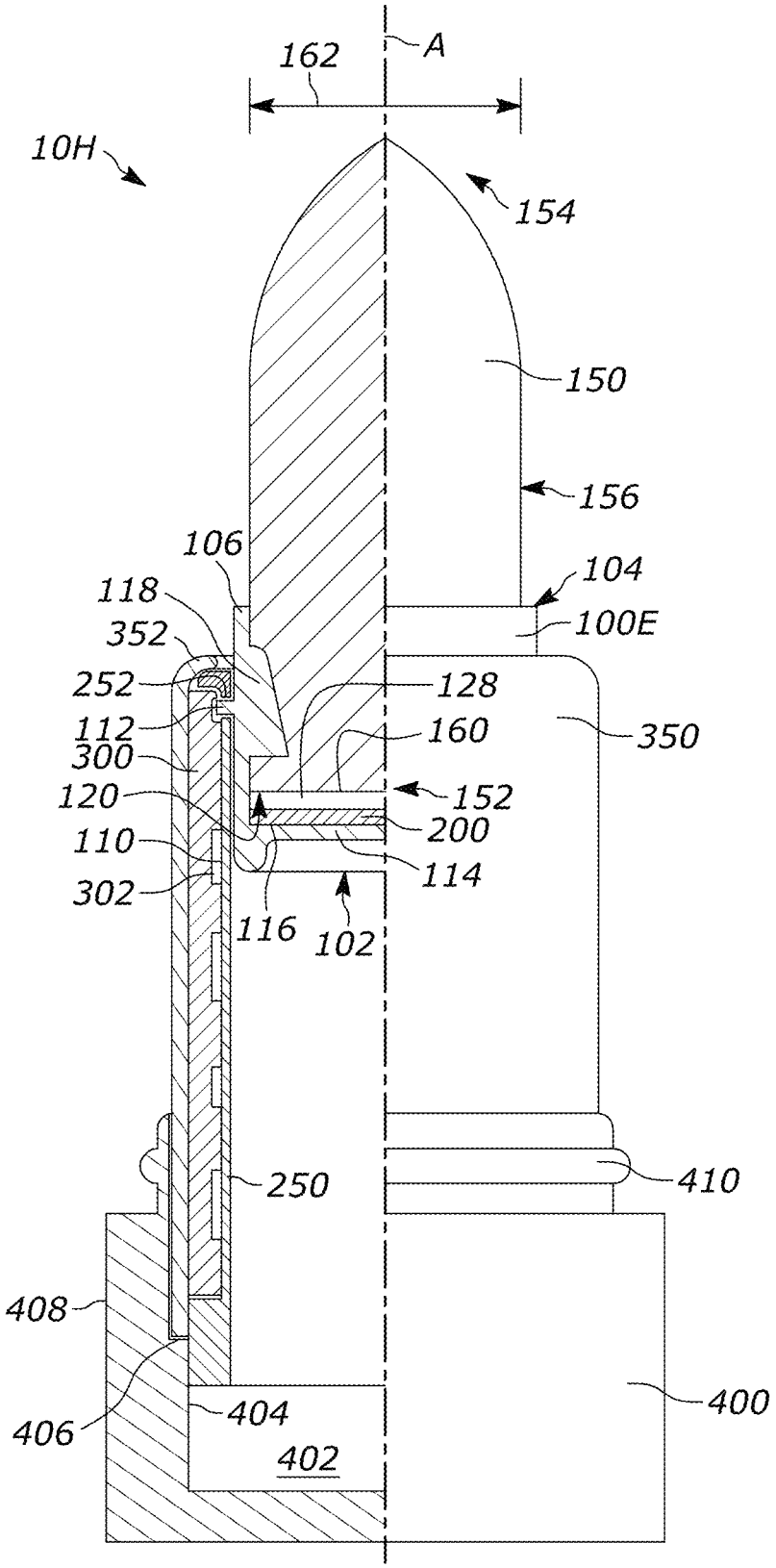
FIG. 9 illustrates a partial cross-sectional front view of the cosmetic product of FIG. 1 having a seventh example cosmetic substance retention mechanism.

Referring to FIG. 9, an eighth example cosmetic product 10H is illustrated. Cosmetic product 10H is substantially the same as cosmetic product 10G, except that cup 100E includes at least one longitudinally extending rib 118 that extends from an inner surface 108 of sidewall 106 and radially into cup cavity 120. While ribs 118 are illustrated as extending generally longitudinally (i.e., generally parallel to longitudinal axis A), in some implementations, ribs 118 may be arranged in a non-longitudinal direction or a helical arrangement. Other arrangements are also possible.

Figure 10:
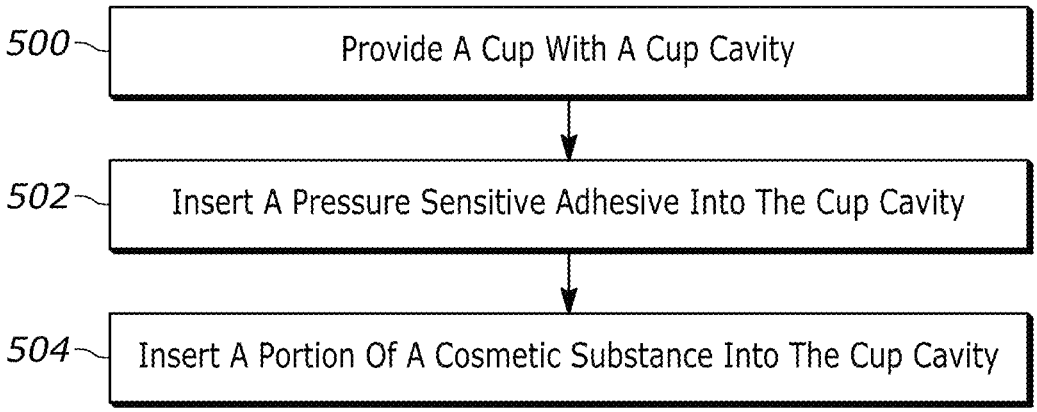
FIG. 10 is a flowchart illustrating a first example method of assembling a cosmetic product in accordance with various examples.

Referring to FIG. 10, a first example method of assembling a cosmetic product (e.g., cosmetic product 10A, 10B, 10C, 10D, 10E, 10F, 10G, 10H) is illustrated. To assemble the cosmetic product, at Step 500, a cup (e.g., cup 100, 100A, 100B, 100C, 100D, 100E) having a cup cavity (e.g., cup cavity 120) is provided. As described above, the cup can have elongated ribs on an inner surface of a sidewall, one or more elongated ridges on a floor member, one more elongated grooves on the floor member, one or more apertures through the floor member, etc.

At Step 502, a pressure sensitive adhesive (e.g., pressure sensitive adhesive 200) is inserted into the cup cavity of the cup. As discussed above, the pressure sensitive adhesive could be a hot melt adhesive and/or silicone based. In some implementations, the pressure sensitive adhesive can be auto-applied, for example, using a Nordson® DuraPail® bulk melter, which could provide simple, uniform, quick application of the pressure sensitive adhesive. In one implementation (e.g., assembly of cosmetic product 10A, 10C, 10E, 10F, 10G, 10H), the pressure sensitive adhesive can be positioned on an inner surface (e.g., inner surface 116) of a floor member (e.g., floor member 114) of the cup, or within one or more grooves (e.g., first elongated groove 128 and second elongated groove 130) in the floor member, so that the pressure sensitive adhesive is located between and contacts the inner surface of the floor member, or one or more groove, and a bottom surface (e.g., bottom surface 160) of the cosmetic substance. In other implementations (e.g., assembly of cosmetic product 10B or 10D), the pressure sensitive adhesive can be positioned on an inner surface (e.g., inner surface 108) of a sidewall (e.g., sidewall 106) of the cup so that the pressure sensitive adhesive is located between and contacts the inner surface of the sidewall and a side surface (e.g., side surface 158) of the cosmetic substance. As discussed above, the pressure sensitive adhesive can be applied to the inner surface of the sidewall of the cup to form an annular ring, to form multiple annular rings, to form multiple spaced apart segments, to form multiple spaced apart segments that are positioned between ribs (e.g., ribs 118), etc.

At Step 504, at least a portion of a cosmetic substance (e.g., first end 152 of cosmetic substance 150) is inserted into the cup cavity of the cup such that the pressure sensitive adhesive is located between and contacts the cup and the cosmetic product. In some implementations (e.g., cosmetic product 10A, 10C, 10E, 10F, 10G, 10H), the outer dimension (e.g., outer cross-sectional dimension 162) of the cosmetic substance can be similar to an inner cross-sectional dimension of the sidewall, such that insertion of the cosmetic substance causes a portion of an elongated body (e.g., elongated body 156) of the cosmetic substance to contact the sidewall. In other implementations (e.g., cosmetic product 10C and 10D), inserting the cosmetic substance into the cup cavity can cause elongated ribs (e.g., ribs 118) to gently insert into a portion of the cosmetic substance.

In addition, the cup can be at least partially positioned within and coupled to an inner body (e.g., inner body 250), which can retain the cup in a relatively fixed position with respect to longitudinal axis A. The cup can be coupled to the inner body before or after the cosmetic substance has been inserted into the cup. As discussed above, when positioning the cup in the inner body, a cup retention member (e.g., cup retention member 112) that extends from an outer surface (e.g., outer surface 110) of the sidewall of the cup can be inserted into a notch (e.g., notch 252) formed in the inner body. In some implementations, the cup retention member can apply an urging force towards the cup cavity when the cup is positioned in the inner body.

With the cup positioned within the inner body, the inner body can be at least partially positioned within a track (e.g., track 300) and the cup retention member can be inserted into a channel (e.g., channel 302) formed in the track.

With the cup, inner body, and track assembled, a shell (e.g., shell 350) can be positioned over at least a portion of the inner body and the track, the shell, and the inner body can be inserted into a base (e.g., base 400). The track, the shell, and the inner body can be inserted into a base cavity (e.g., base cavity 402) of the base until the shell engages a ledge (e.g., ledge 406) formed in the base. In some implementations, the shell, the track, and or the inner body can be fixed relative to the base while the cup is rotatable relative to the base so that the base can be twisted in a first direction relative to the shell to advance the cosmetic substance to a position beyond the shell and can be twisted in a second direction, opposite to the first direction, relative to the shell to retract the cosmetic substance to a position substantially within the shell.

So configured, the pressure sensitive adhesive and cosmetic products described herein securely retain the cosmetic substance within the cup without damaging the cosmetic substance. The pressure sensitive adhesive can increase adhesion between the cosmetic substance and the cup to assist with retaining the cosmetic substance within the cup cavity during use, drops, and/or other unintended movements. Further, the pressure sensitive adhesive and cosmetic products do not include additional stress concentration areas that may otherwise result in the cosmetic substance being fractured, stretched, or otherwise damaged during unintentional movements.

Figure 11:
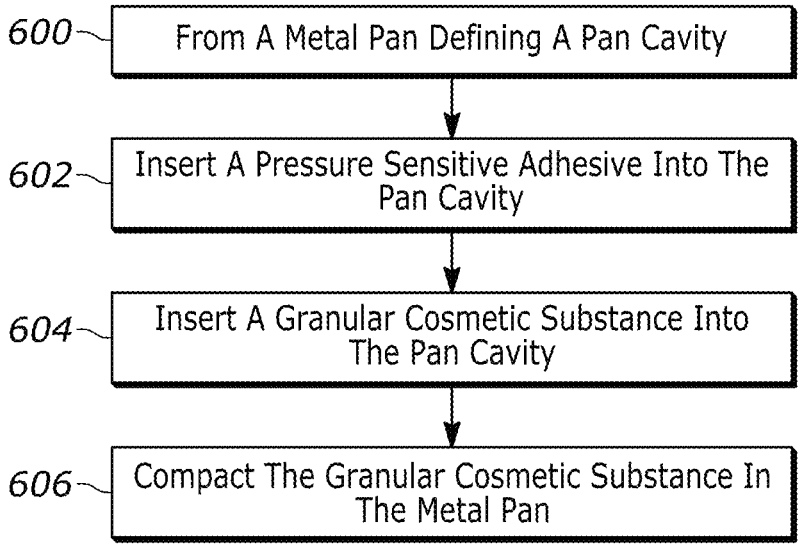
FIG. 11 is a flowchart illustrating a second example method of assembling a cosmetic product in accordance with the examples illustrated in FIGS. 12A-12B.

Referring to FIG. 11, a second example method of assembling a cosmetic product (e.g., cosmetic product 700A illustrated in FIG. 12A or cosmetic product 700B illustrated in FIG. 12B) is illustrated. To assemble the cosmetic product, at Step 600, a metal pan (e.g., metal pan 702) having a pan cavity (e.g., pan cavity 704) is formed. The metal pan can be pressed from a metal sheet, machined, or formed using any other appropriate manufacturing technique. The metal pan can be cylindrical and include a floor member (e.g., floor member 706) and a sidewall (e.g., sidewall 710) extending from the floor member.

At Step 602, a pressure sensitive adhesive (e.g., pressure sensitive adhesive 714, which can be the same a pressure sensitive adhesive 200 described above), such as Dow Corning® HM-1422, is inserted into the pan cavity.

Once the pressure sensitive adhesive has been applied, at Step 604 a granular cosmetic substance (e.g., granular cosmetic substance 716) is inserted into the pan cavity. The granular cosmetic substance can be any cosmetic or skin care product that is provided to a user in a granular compacted form, such as foundation, eye shadow, etc.

Figure 12A:
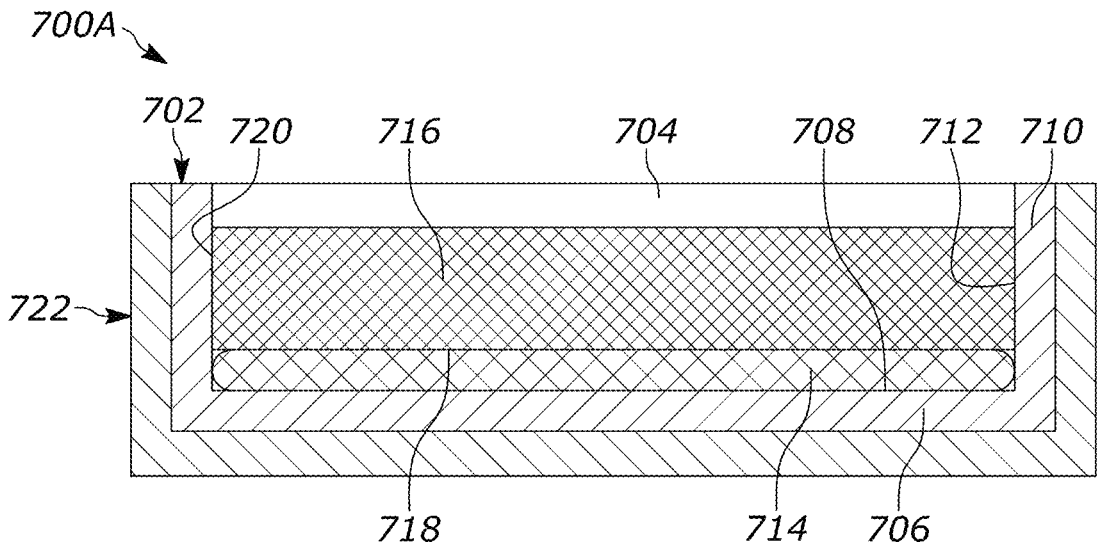
FIG. 12A illustrates a cross-sectional view of a second example cosmetic product in accordance with the example method of FIG. 11.
Figure 12B:
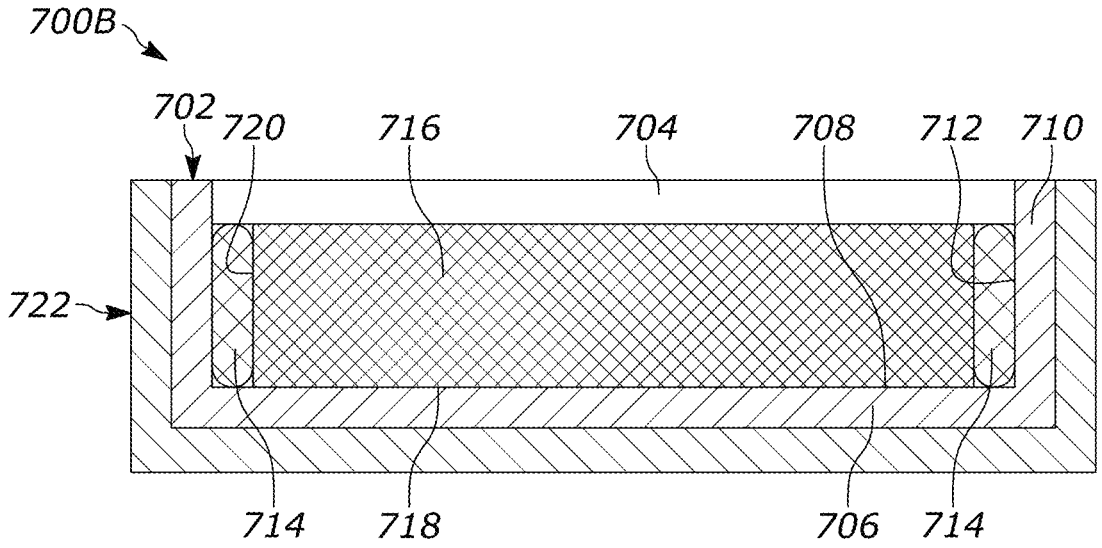
FIG. 12B is illustrates a cross-sectional view of the cosmetic product of FIG. 12A with the pressure sensitive adhesive in an alternative location.

At Step 606, the granular cosmetic substance is then compacted in the metal pan such that the pressure sensitive adhesive is positioned between and contacts at least a portion of the metal pan and at least a portion of the compacted granular cosmetic substance. For example, as shown in FIG. 12A, the pressure sensitive adhesive can be located between and contact an inner surface (e.g., inner surface 708) of the floor member of the metal pan and a bottom surface (e.g., bottom surface 718) of the compacted granular cosmetic substance. Alternatively, as shown in FIG. 12B, the pressure sensitive adhesive can be located between and contact an inner surface (e.g., inner surface 712) of the sidewall of the metal pan and a side surface (e.g., side surface 720) of the compacted granular cosmetic substance. As discussed above, when positioned between the inner surface of the sidewall of the metal pan and the side surface of the compacted granular cosmetic substance, the pressure sensitive adhesive can be applied to form an annular ring or can be applied as multiple segments around the sidewall.

The metal pan can also be secured in an external housing (e.g., external housing 722) in producing a final product.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises", "comprising", "has", "having," "includes", "including", "contains", "containing", or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about", or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A cosmetic product, comprising:

a cup having a sidewall and a floor member, the sidewall and the floor member defining a cup cavity, the floor member comprising: a first elongated ridge extending across the floor member and protruding from an inner surface of the floor member into the cup cavity; and a second elongated ridge extending across the floor member and protruding from the inner surface of the floor member into the cup cavity, the second elongated ridge intersecting the first elongated ridge;

a cosmetic substance, at least a portion of the cosmetic substance disposed within the cup cavity; and a pressure sensitive adhesive located between and contacting the floor member of the cup, between the first elongated ridge and the second elongated ridge, and the cosmetic substance.

2. The cosmetic product of claim 1, wherein the pressure sensitive adhesive is a hot melt adhesive.

3. The cosmetic product of claim 1, wherein the pressure sensitive adhesive is silicone based.

4. The cosmetic product of claim 1, comprising an inner body, wherein the cup is configured to be at least partially disposed within the inner body.

5. The cosmetic product of claim 4, wherein: the cup comprises a cup retention member extending from an outer surface of the sidewall; and the cup retention member is configured to engage a notch formed in the inner body.

6. The cosmetic product of claim 5, wherein the cup retention member is configured to apply an urging force towards the cup cavity with the cup inserted into the inner body.

7. The cosmetic product of claim 1, wherein the floor member comprises an aperture formed through the floor member, at least a portion of the aperture being positioned between the first elongated ridge and the second elongated ridge.

8. A cosmetic product, comprising:

a cup having a sidewall and a floor member, the sidewall and the floor member defining a cup cavity, the floor member comprising: a first elongated groove extending across the floor member and protruding into an inner surface of the floor member; and a second elongated groove extending across the floor member and protruding into the inner surface of the floor member, the second elongated groove intersecting the first elongated groove;

a cosmetic substance, at least a portion of the cosmetic substance disposed within the cup cavity; and a pressure sensitive adhesive located at least partially within the first elongated groove and the second elongated groove, the pressure sensitive adhesive contacting the first elongated groove and the second elongated groove of the floor member of the cup and the cosmetic substance.

9. The cosmetic product of claim 8, wherein the pressure sensitive adhesive is a hot melt adhesive.

10. The cosmetic product of claim 8, wherein the pressure sensitive adhesive is silicone based.

11. The cosmetic product of claim 8, comprising an inner body, wherein the cup is configured to be at least partially disposed within the inner body.

12. The cosmetic product of claim 11, wherein: the cup comprises a cup retention member extending from an outer surface of the sidewall; and the cup retention member is configured to engage a notch formed in the inner body.

13. The cosmetic product of claim 12, wherein the cup retention member is configured to apply an urging force towards the cup cavity with the cup inserted into the inner body.

14. The cosmetic product of claim 8, wherein the floor member comprises an aperture formed through the floor member, at least a portion of the aperture being positioned between the first elongated groove and the second elongated groove.

15. A method of assembling a cosmetic product, comprising:

forming a metal pan, the metal pan defining a pan cavity;

inserting a pressure sensitive adhesive into the pan cavity;

inserting a granular cosmetic substance into the pan cavity; and compacting the granular cosmetic substance in the metal pan such that the pressure sensitive adhesive is located between and contacts at least a portion of the metal pan and at least a portion of the compacted granular cosmetic substance.

16. The method of claim 15, comprising securing the metal pan in an external housing.

17. The method of claim 15, wherein inserting the pressure sensitive adhesive into the pan cavity comprises positioning the pressure sensitive adhesive on an inner surface of a floor member of the metal pan such that the pressure sensitive adhesive is located between and contacts the inner surface of the floor member of the metal pan and a bottom surface of the compacted granular cosmetic substance.

18. The method of claim 15, wherein inserting the pressure sensitive adhesive into the pan cavity comprising positioning the pressure sensitive adhesive on an inner surface of a sidewall of the metal pan such that the pressure sensitive adhesive is located between and contacts the inner surface of the sidewall of the metal pan and a side surface of the compacted granular cosmetic substance.

19. The method of claim 18, wherein the pressure sensitive adhesive forms an annular ring.

20. The method of claim 15, wherein the pressure sensitive adhesive is silicone based.

* * * * *